United States Patent [19]

Knapp

[11] Patent Number: 4,792,718

[45] Date of Patent: Dec. 20, 1988

[54] CATHODE RAY DISPLAY TUBES

[75] Inventor: Alan G. Knapp, Crawley, England

[73] Assignee: U.S. Philips Corporation, New York, N.Y.

[21] Appl. No.: 89,807

[22] Filed: Aug. 27, 1987

[30] Foreign Application Priority Data

Sep. 29, 1986 [GB] United Kingdom ..... 8623386

[51] Int. Cl.[4] ..... H01J 31/48; H01J 43/04

[52] U.S. Cl. ..... 313/399; 313/400; 313/103 CM; 313/105 R; 313/105 CM

[58] Field of Search ..... 313/103 R, 103 CM, 104, 313/105 CM, 105 R, 400, 399, 533, 534, 536

[56] References Cited

U.S. PATENT DOCUMENTS

| | | | |
|---|---|---|---|
| 3,235,765 | 2/1966 | Goodrich et al. | 313/103 CM |
| 3,564,323 | 2/1971 | Maeda | 313/103 CM |
| 3,612,946 | 10/1971 | Toyoda | 313/103 CM |
| 3,849,692 | 11/1974 | Beasley et al. | 313/105 CM |
| 4,041,343 | 8/1977 | Orthuber | 313/105 R |
| 4,071,474 | 1/1978 | Kishimoto | 313/103 CM |
| 4,560,898 | 12/1985 | Knapp et al. | 313/105 CM |

FOREIGN PATENT DOCUMENTS

| | | | |
|---|---|---|---|
| 1417643 | 12/1975 | United Kingdom | 313/105 CM |

*Primary Examiner*—David K. Moore
*Assistant Examiner*—Michael Horabik
*Attorney, Agent, or Firm*—Robert J. Kraus

[57] ABSTRACT

In a display tube a laminated dynode channel plate electron multiplier (16) produces at its channel outputs (50) a current-multiplied beam (34) in response to an electron beam being scanned thereover which is accelerated towards a phosphor screen (14) comprising repeating groups of different color phosphor elements and selectively directed onto particular elements by color selection deflector electrodes (38,40) adjacent the channel outputs. To provide increased horizontal resolution capability the exits (50) of the apertures in the final dynode are elongate in shape, other dynodes having circular apertures, and arranged parallel to one another with their longer axes extending vertically to form a comparatively narrow horizontal width output beam. The final dynode aperture entrances may be similarly elongate or circular with the apertures having a re-entrant profile. An apertured extractor electrode (36) disposed between the multiplier and color selection electrodes may also have elongated apertures (42) to enhance this beam shaping.

13 Claims, 2 Drawing Sheets

Fig. 4.
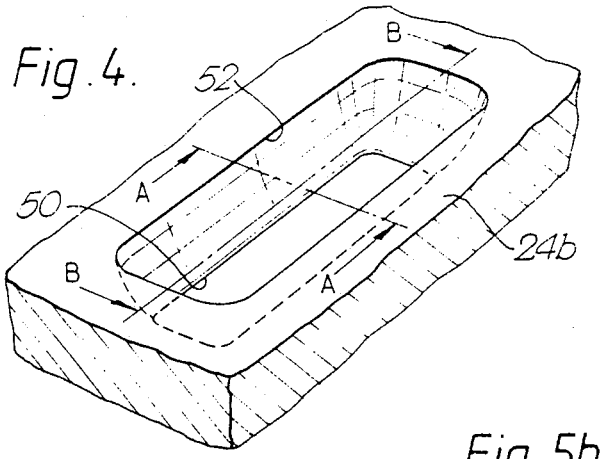
Fig. 5a.
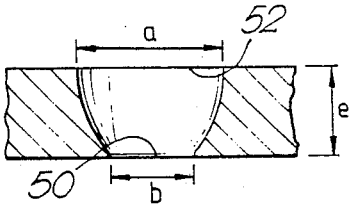
Fig. 5b.
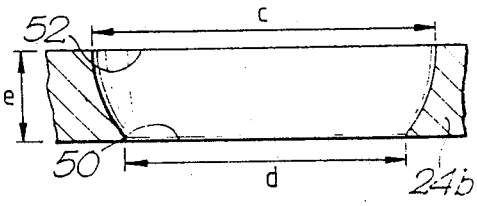
Fig. 6.
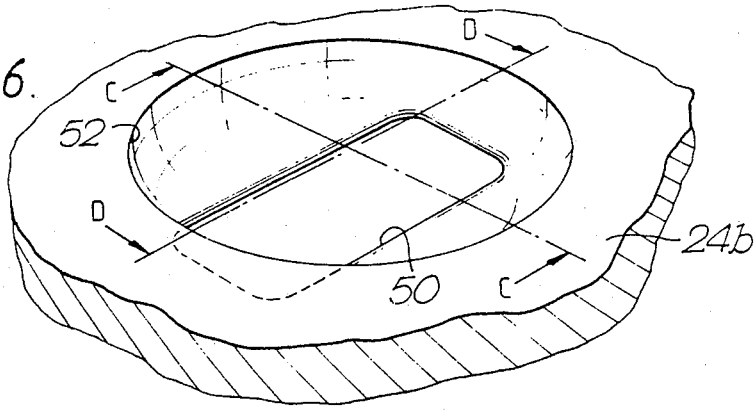
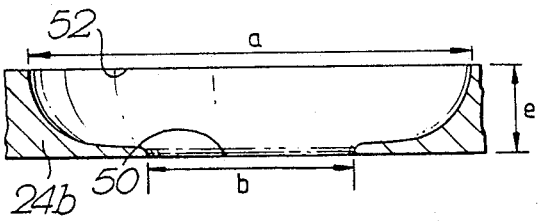
Fig. 7a.
Fig. 7b.
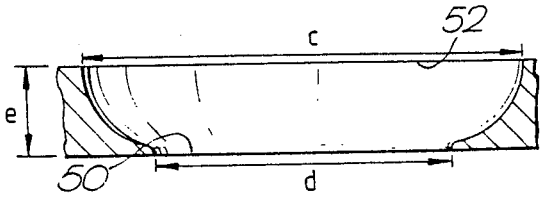

CATHODE RAY DISPLAY TUBES

BACKGROUND OF THE INVENTION

This invention relates to cathode ray display tubes and to channel plate electron multipliers for use therein.

The invention is concerned particularly with a cathode ray display tube comprising means for producing an electron beam, a channel plate electron multiplier for producing at its output side current multiplied electron beams in response to the electron multiplier being scanned by the electron beam over its input side, the channel plate electron multiplier comprising a stack of a plurality of apertured dynodes, the apertures of the dynodes being aligned to provide channels through the stack, a phosphor screen comprising repeating groups of phosphor elements and colour selection means operable to direct selectively the elcctron beams from the channel multiplier onto the respective phosphor elements.

A cathode ray display tube of the aforementioned kind is described in British Patent Specification No. 2,124,017A corresponding to U.S. Pat. No. 4,560,898. In this tube, the phosphor screen comprises a repeating pattern of horizontally separated R (red), G (green) and B (blue) phosphor elements, typically in the form of vertical lines of phosphor material, with each group of three-colour phosphor elements, i.e. triplet, associated with a respective channel of the muliiplier. The dynode apertures are all circularly symmetrical with circular cross-section entrances and exits. A current multiplied electron beam emerging from the output side of the multiplier, and extracted with the aid of an apertured extractor electrode, is directionally controlled by the colour selection means so as to impinge upon one of the three phosphor elements as appropriate. The colour selection means is in the form of a deflection electrode arrangement having a pair of electrodes located on either side of the axis of each channel of the multiplier which are selectively energisible to deflect the output electron beam for example to one side or the other in order to impinge upon the two outer phosphor elements respectively of the associated group or to allow the electron beam to pass generally straight through, with a small amount of deflection if necessary, to impinge on the central phosphor element.

Such a colour display tube enables a reasonable resolution to be achieved but an improvement in its perfrrmance in this respect would be advantageous, particularly for certain tube applications.

SUMMARY OF THE INVENTION

It is an object of the present invention to provide a cathode ray display tube generally of the aforementioned kind having improved resolution capabilities.

According to one aspect of the present invention, there is provided a cathode ray display tube comprising means for producing an electron beam, a channel plate electron multiplier for producing at its output side current multiplied electron beams in response to the electron multiplier being scanned by the electron beam over its input side, the channel plate electron multiplier comprising a stack of a plurality of apertured dynodes, the apertures of the dynodes being aligned to provide channels through the stack, a phosphor screen comprising repeating groups of phosphor elements and colour selection means operable to direct selectively the electron beams from the channel multiplier onto the respective phosphor elements, wherein the exits of the apertures in the final dynode at the side thereof adjacent the colour selection means are elongate in shape and oriented substantially parallel to one another.

The display tube in accordance with the invention has superior resolution capabilities. It has been recognised that one of the most important features determining the maximum resolution obtainable from a channel plate multiplier kind of cathode ray display tube is the width of the electron beam from the colour selection means when it reaches the phosphor screen. This beam should be sufficiently narrow that electrons fall on only one of the three phosphor elements of the group concerned and do not excite the adjacent phosphor elements as this results in a loss of colour purity. Therefore the pitch of the phosphor element triplets, (groups) which determines the horizontal resolution of the display, is dependent upon the width of the spot the electron beam produces at the screen, a smaller spot width allowing a finer pitch and thus greater resolution.

By making the apertures of the final dynode at the side thereof adjacent the colour selection means elongate in shape in accordance with the invention, it has been found that a smaller spot width in the horizontal direction can be produced, thus enabling a finer phosphor element pitch to be used. With the electron multiplier arranged with respect to the screen such that the longer dimension of the elongate exits of the apertures in the final dynode extend vertically and parallel to the phosphor stripes and the shorter dimensions extend horizontally and at right angles to the phosphor stripes the shape of the beam spot at the screen is controlled to be much narrower in the horizontal direction than previously whilst being longer in the vertical direction so as to provide good output brightness from the screen. By way of example, the reduction in beam spot width attained has been found to allow the display resolution to be increased by a factor of at least 1.6 times so that phosphor triplet pitches of around 0.3 mm are obtainable. In the event that such high resolution is not required, the invention has the further advantage in that wider manufacturing tolerances can be used at larger triplet pitches since a larger sideways displacement of the spot on the screen becomes possible before it spills over onto adjacent phosphor stripes causing a loss of colour purity.

In the cathode ray display tube disclosed in British Patent Specification No. 2124017A, an extractor electrode, comprising an apertured sheet, is disposed intermediate the final dynode of the multiplier and the colour selection means electrodes with its apertures aligned with the multiplier channels for extracting the current multiplied electron beam from the final dynode. In one embodiment described, the apertures in the extractor electrode are made elongate having a length greater than, and a width narrower than, the diameter of the circular exit aperture of the final dynode with a view to reducing the spot size in the horizontal direction on the screen and improving colour purity for a given phosphor pitch. In actual practice, the degree of shaping in this manner obtained from such an extractor electrode is relatively small. The present invention, however, provides a considerably greater degree of beam shaping and leads to a significant improvement in resolution capability. In order to enhance still further the desired beam shaping characteristic, the display tube of the present invention may include an extractor electrode of the above-described form with the elongate apertures of the extractor electrode arranged to extend substantially parallel to the elongate exit apertures of the final dynode. Besides enhancing beam shaping, the provision of this extractor electrode has the additional advantage that the elongate extractor electrode apertures assist the quadrupole lens field produced by the deflector electrodes of the colour selection means in the beam shaping process.

Alternatively, the extractor electrode may have circular apertures instead.

At least the final dynode, and preferably all the dynodes of the electron multiplier apart from the first dynode, may comprise two apertured half dynodes, each in the form of an apertured sheet for example, joined together, respective apertures in the two half dynodes communicating with one another and together constituting the dynode apertures. In this case, the apertures in the half dynode of the last dynode defining the output side of the electron multiplier may have elongate entrances leading to correspondingly elongate exits or alternatively circular entrances leading to elongate exits. In both cases, the aforesaid entrances preferably have a greater cross-sectional area than the exits and are arranged symmetrically with respect to the exits with the internal wall of each aperture being smoothly curved between the entrance and exit. In use of the multiplier, these walls act as secondary emitting surfaces of the final dynode and for this purpose the half dynode may for example either be formed entirely of secondary emissive material or secondary emissive material may be used to define the aperture walls.

Where this half dynode has elongate aperture entrances, the other half dynode of the final dynode may have correspondingly elongate aperture exits leading from circular or elongate entrances of smaller cross-sectional area. Where this half dynode of the final dynode defining the output side of the multiplier has circular aperture entrances, the other half dynode of the final dynode may have circular aperture exits leading from circular entrances.

The remaining dynodes may all have apertures with circular entrances and exits. Alternatively, in the case where the apertures of the final dynode have both elongate entrances and exits, possibly one or more immediately preceding and consecutive dynodes may also have apertures with elongate exits, and the remaining dynodes, comprising the input dynode and one or more consecutive and succeeding dynodes, have apertures with circular entrances and exits. With regard to this embodiment, it has been found that an electron multiplier in which the dynodes throughout have apertures with elongate exits does not operate satisfactorily and it is desirable therefore that at least the first dynode, defining the multiplier input side, and preferably a number of consecutive dynodes including that first dynode, have apertures with circular entrances and exits.

The apertures in at least the second dynode to the penultimate dynode of the electron multiplier are each preferably barrel shaped having a re-entrant profile with an increased cross-sectional dimension intermediate their entrance and exit. The first, input side, dynode may have a similar shape or may comprise only one half-dynode sheet in which the aperture entrances are greater than their exits in area.

Other aspects of the present invention will become apparent from the following description of preferred embodiments.

DESCRIPTION OF THE DRAWING

Cathode ray display tubes in accordanee with the invention will now be described by way of example, with reference to the accompanying drawing figures in which:

FIG. 4 is a scrap perspective view showing a typical aperture in a part of the final dynode of the electron multiplier;

FIGS. 5*a* and 5*b* are sectional views along the lines A—A and B—B respectively of FIG. 4;

FIG. 6 is a view similar to that of FIG. 4 showing an alternative form of aperture;

FIGS. 7*a* and 7*b* are sectional views along the lines C—C and D—D respectively of FIG. 6.

DESCRIPTION OF THE PREFERRED EMBODIMENTS

Figure 1:
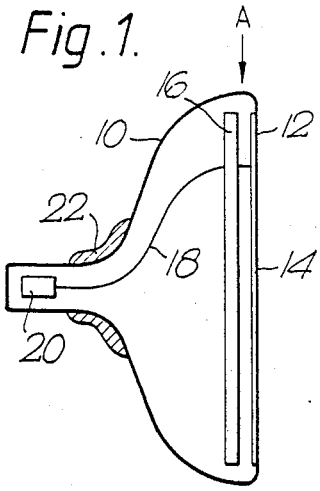
FIG. 1 is a diagrammatic elevation through one form of colour picture display tube made in accordance with the present invention.

In the drawings figures corresponding reference numerals have been used to indicate the same parts in each of the embodiments.

The colour display tube shown in FIG. 1 comprises an envelope 10 with a substantially flat faceplate 12. On the faceplate 10 a phosphor screen 14 is provided comprising repeating groups of red, R, green, G, and blue, B, vertically extending phosphor lines. Adjacent phosphor lines may be separated by black matrix material. A laminated channel plate electron multiplier 16 is arranged parallel to, but spaced from, the screen 14. A device for producing a low energy electron beam 18, for example an electron gun 20, is disposed in a neck of the envelope 10. The electron beam 18 is scanned in raster fashion across the input face of the electron multiplier 16 by deflection means 22 mounted on the tube neck.

The invention is not limited to the particular form of tube shown in FIG. 1. In an alternative embodiment, the tube may be a flat tube having the form described in British Patent Specification No. 2,101396A, details of which are incorporated herein by way of reference, which also utilises a channel plate electron multiplier and in which a folded electron beam path to the multiplier is used.

A portion of the channel plate electron multiplier 16, the phosphor screen 14 and the faceplate 12, together with associated portions of an extractor electrode and colour selection electrode structure (not visible in FIG. 1), are shown in detail in FIG. 2 Apart from certain differences which will be described, these components are generally similar to the corresponding components of the display tube arrangement described in British Patent Specification No. 2,124,017A, whose disclosure in this respect accordingly is included herein by way of reference. As such only brief details of common features will be described here and the reader is invited to refer to the aforementioned specification for a more detailed description of these common features.

Figure 2:
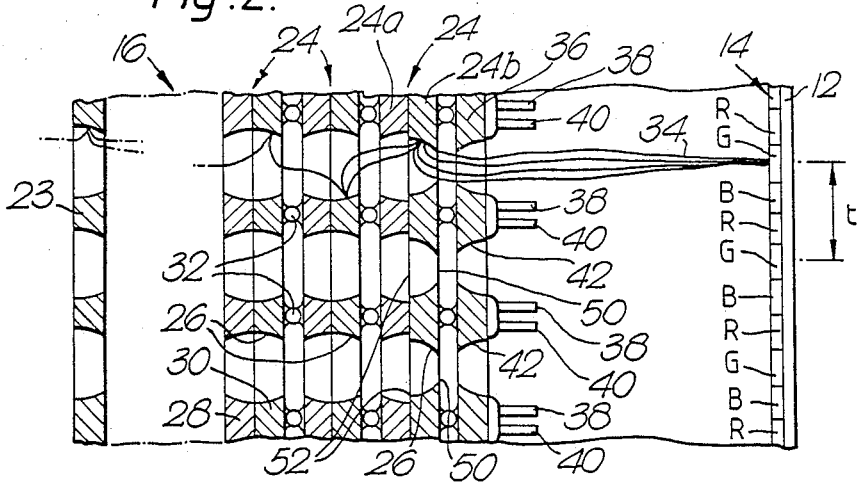
FIG. 2 is a sectional view, not to scale, of a portion of the final three stages of a laminated channel plate electron multiplier, extractor electrode, colour selection electrodes, screen and faceplate of the tube of FIG. 1 viewed in the direction of the arrow A in FIG. 1.

The electron multiplier 16 comprises a plurality of discrete apertured dynodes 23 and 24, typically, seven altogether, of which the the first, 23, and the last three, 24, are shown in FIG. 2. Apertures 26 in successive dynodes are aligned with each other to form channels. The dynodes 24 in fact comprise two half dynodes 28, 30, arranged back to back whereas the first dynode 23 comprises a single half dynode arranged as shown. Successive dynodes 23 and 24 are separated from each other by a resistive or insulating spacing means which in the illustrated embodiment comprise small glass balls 32 known as ballotini. In operation the electron beam 18 entering a channel undergoes current multiplication b secondary emission as it passes from one dynode to the next, each of which is typically 300 V more positive than the previous one. To this end, the walls of the apertures in the first dynode 23 and the walls of the aperture portions in the dynodes 24 defined by the downstream half dynode in each case comprise secondary emissive material. In order to extract the current multiplied electron beam 34 from the final dynode of the electron multiplier 16, an extractor electrode 36 is provided. This extractor electrode 36 comprises an apertured sheet mounted on, but spaced and insulated from, the final dynode and whose apertures, 42, are aligned with those of the final dynode. A positive voltage typically +150 V relative to that of the last dynode, is applied to the extractor electrode 36 which not only draws out the electron beam 34 but also acts to focus it to some extent.

With the illustrated arrangement of the phosphors R, G and B in the repeating groups, an undeflected, current multiplied electron beam 34 will impinge on the green phosphor G. To impinge on the red, R, and blue, B, phosphors the electron beam 34 has to be deflected to the left and to the right respectively. In the illustrated embodiment the deflection of the current multiplied electron beam 34, and hence colour selection, is achieved by pairs of electrodes 38, 40 arranged one on each side of an aperture 42 in the extractor electrode 36. The apertures 42 are aligned rectilinearly in columns, corresponding to the multiplier channels and the electrodes 38, 40 are elongate. All the electrodes 38 are interconnected as are the electrodes 40, and are formed as strips extending vertically between each columnoof apertures 42. The electrodes 38, 40 are electrically insulated from the extractor electrode 36. The deflector electrodes 38, 40 act as part of the lens system which assists in forming an electron beam 34 of the required size. The electrodes 38, 40 produce a quadropole field which tends to reduce slightly the size of the spot on the screen in the x or lateral direction whilst increasing it in they or vertical direction.

In operation, in order to deflect the electron beam 34 it is necessary to apply a potential difference between the sets of electrodes 38, 40. In a situation where relative to the final dynode the extractor electrode 36 is at, say, +100 V and the screen 14 is at +7 to 12 kV, then for an undeflected beam 34 a mean voltage of +700 V is applied to the electrodes 38, 40 and to obtain a deflection in one direction or the other a potential difference of, for example 50 V, has to be produced so that for a deflection onto the red phosphor, R, the electrode 40 is at say 725 V whilst the electrode 38 is at +675 V, the voltages being the opposite way around for deflection onto the blue phosphor, B. With no potential difference between the electrodes, the beam impinges on the green phosphor, G.

Figure 3:
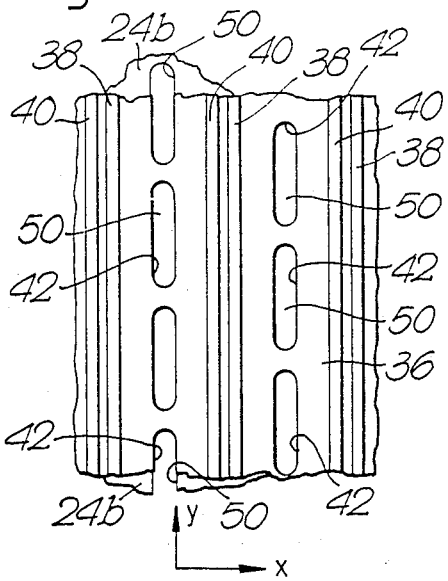
FIG. 3 is a diagrammatic elevational view, not to scale, of a portion, partly cut-away, of the output side of the electron multiplier, extractor electrode and colour selection electrodes.
Figure 8:
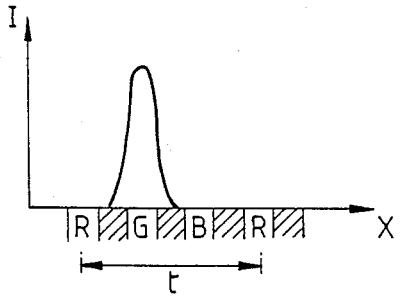
FIG. 8 is a graph illustrating relative to the phosphor screen structure of the tube a desired electron beam characteristic.

Several parameters have an influence on the electron beam spot width at the screen, including the extractor electrode voltage and the mean potential on the colour selection means deflector electrodes 38, 40. FIG. 8 is a graph showing electron beam intensity I against horizontal distance, X at the screen and illustrates a desirable electron beam shape characteristic in relation to the phosphor triplet pitch, t, also indicated in FIG. 2. In this illustration, the screen is shown as comprising R, G and B phosphor lines mutually separated by black matrix material. As can be seen, the width of the beam spot, in the X direction, is such that it impinges only on one phosphor line, in this case the green line, and adjacent black matrix material. If the beam spot were to have a larger width, marginal electrons would impinge also on adjacent red and blue phosphor lines, leading to a loss of colour purity. To assist in forming a narrow beam spot, a comparatively low extractor electrode voltage is preferable. However, this results in a low extraction field for secondary electrons from the final dynode of the multiplier and hence a low gain-efficiency for that stage of the multiplier. An improved efficiency is achieved by making the apertures 42 in the extractor electrode 36 of slotted form. These symmetrical and elongate apertures 42, as shown in FIG. 3, are oriented with their respective longer axes of symmetry extending vertically, in the y direction, parallel to the phosphor lines of the screen 14 and the deflection electrodes 38, 40. This configuration enables a larger extractor potential to be used for the same spot width, and leads to a significant increase in output current from the multiplier.

In order to significantly further reduce the beam sptt width, and hence enable high resolution to be achieved, the exit of the apertures in the final dynode of the multiplier are made elongate in shape, and arranged parallel to one another similar to the extractor electrode apertures. More particularly the exit apertures in the final dynode are symmetrical, with orthogonal lines of symmetry passing through their centre. In specific embodiments, as shown in FIGS. 3, 4, 5, 6 and 7, the exit apertures, designated 50, have generalyy straight, parallel, sides extending along their longer dimension with smoothly rounded ends. The aperture exits 50 are each oriented with their longer axis extending vertically, in the y direction, and parallel to the phosphor stripes of the screen 14 and the deflector electrodes 38, 40 so that they have a smaller dimension in the direction perpendicular to the phosphor stripes than in the direction parallel to the phosphor stripes.

As previously mentioned, the dynodes 24 of the electron multiplier are each formed from two half dynodes 28, 30 arranged back to back and defining respective portions of the dynode apertures, these half dynodes being referenced as **24*a* and 24*b* in the case of the final dynode in FIG. 2. In the embodiment of FIG. 2, the dynodes 24, apart from the final dynode, have circular symmetric apertures with a re-entrant profile such that they have an increased cross-sectional dimension intermediate the aperture entrances and exits. By way of example, the electron multiplier has a channel pitch of approximately 0.55 mm and the apertures of the dynodes 24 apart from the final dynode have circular entrances and exits of approximately 0.30 mm diameter and their diameters at the mid-point, that is, whrre the two half dynodes meet, is approximately 0.55 mm. In the example illustrated, the first half dynode 24***a* of the final dynode 24 is identical to the first half dynodes 28 of the remaining dynodes 24. The second half dynode 24*b* of the final dynode has apertures of the form shown in FIG. 4 or FIG. 6. Referring to these figures, both forms of apertures have the same exit shape, this being elongate. In the FIG. 4 variant, the aperture entrance, 52, in this half dynode 24*b* is similarly elongate, but has a larger cross-sectional area that the aperture exit. The aperture entrance 52, which is arranged symmetrically with respect to the exit, leads to the aperture exit, 50, via a cross-sections through this aperture. By way of example, the dimensions a, b, c, d and e indicated in FIGS. 5*a* and 5*b* are 0.31 mm, 0.13 mm, 0.49 mm, 0.34 mm and 0.15 mm respectively, the latter dimension corresponding to the thickness of each of the half dynodes of the dynodes 24.

In the FIG. 6 variant, the aperture entrance 52 in the half dynode 24*b* is circular and again larger in area than the aperture exit 50. The aperture entrance, which again is arranged symmetrically with respect to the exit, leads to the exit via a smoothly curved wall surface. FIGS. 7*a* and 7*b*, like FIGS. 5*a* and 5*b*, show cross-sections through the aperture. In this case, and by way of example, the dimensions a, b, c, d and e are, respectively, 0.45 mm, 0.13 mm, 0.45 mm, 0.38 mm and 0.15 mm.

The sections shown in FIGS. 5 and 7 pass through the centres of their respective apertures and thus constitute sections taken through the mutually perpendicular longitudinal and transverse axes of symmetry of the aperture entrances 52 and exits 50.

The half dynode 24*b*, with either elongate or circular aperture entrances 52, is mated to the half dynode 24*a* with its circular apertures, whereby each aperuure in the final dynode has a circular entrance, facing the penultimate dynode, and an elongate exit, facing the extractor electrode 26.

The slots 42 in the extractor electrode 36 may be approximately the same size as the aperture exits 50 in the final dynode or may be slightly larger.

With this arrangement, and using the aperture configuration illustrated in FIG. 4, the width of the electron beam spot on the screen 14 (measured at 1/e of the peak height) was 0.080 mm compared with values of 0.13 to 0.14 mm obtained with a similar arrangement but using a circularly symmetiic apertured last half dynode for the final dynode, i.e. the same kind of half dynode as used in the other dynodes 24. This improvement allows the display resolution to be increased by a factor of a least 1.6 times so that phosphor triplet pitches (d) of around 0.3 mm are obtainable.

In another embodiment, the final dynode 24 may be formed with apertures having both elongate entrances and exits. In this case, the second half dynode 24*b* would be generally as previously described with apertures as shown in FIG. 4 and the first half dynode 24*a* formed with similarly shaped and sized apertures. The two half dynodes are mounted back to back with the fisst half dynode 24*a* arranged oppositely to the second half dynode 24*b* such that their sides having the larger area openings are facing one another. The apertures through this final dynode would then have elongate entrances and exits with increased cross-sectional dimensions therebetween. However, there is likely to be some loss of gain with this arraneement because of the shape of the aperture entrance relative to the aperture exit shape of the penultimate dynode. In a modified version of this embodiment, the penultimate dynode may simllarly be provided with elongate aperture exits, and possibly elongate aperture entrances as well. Indeed, depending on the number of dynodes 24 in the electron multiplier, the last three or more consecutive dynddes may have elongate apertureeexits and, apart from the first dynode in this series, elongate aperture entrances as described above with reference to the final dynode 24. The aperture entrances of the first dynode in this final series of dynodes may have either circular or elongate aperture entrances as previously described with reference to the final dynode 24. However, with such an arrangement having a number of consecutive dynodes 24 including the final dynode all having elongate aperture exits, a number of consecutive dynodes starting from the electron multiplier's input side and including the first dynode should be formed with circularly-symmetrical apertures.

I claim:

1. A cathode ray display tube comprising means for producing an electron beam, a channel plate electron multiplier for producing at its output side current multiplied electron beams in response to the electron multiplier being scanned by the electron beam over its input side, the channel plate electron multiplier comprising a stack of a plurality of apertured dynodes, the apertures of the dynodes being aligned to provide channels through the stack, a phosphor screen comprising repeating groups of phosphor elements and colour selection means operable to direct selectively the electron beams from the channel multiplier onto the respective phosphor elements, wherein the exits of the apertures in the final dynode at the side thereof adjacent the colour selection means are elongate in shape and oriented substantially parallel to one another.

2. A cathode ray display tube according to claim 1, characterised in that the tube further includes an apertured extractor electrode disposed intermediate the final dynode of the electron multiplier and the colour selection means for extracting electrons from the final dynode, the apertures in the extractor electrode being aligned with the channels of the electron multiplier.

3. A cathode ray display tube according to claim 2, characterised in that the extractor electrode apertures are elongate and arranged to extend substantially parallel to the elongate aperture exits in the final dynode.

4. A cathode ray display tube according to any one of claims 1, 2 or 3, characterised in that at least the final dynode of the electron multiplier comprises two apertured half dynodes joined together with respective apertures in the two half dynodes communicating with one another and together constituting the dynode apertures.

5. A cathode ray display tube according to claim 4, characterised in that the apertures in the half dnnode of the final dynode defining the output side of the multiplier have entrances which are greater in area than the aperture exits therein and which are arranged symmetrically with respect to the aperture exits with the wall of each aperture being smoothly curved between the entrance and exit.

6. A cathode ray display tube according to claim 5, characterized in that the apertures in the half dynode of the final dynode defining the output side of the multiplier have elongate entrances leading to said elongate exits.

7. A cathode ray display tube according to claim 5 characterised in that the apertures in the half dynode of the final dynode defining the output side of the multiplier have circular entrances leading to said elongate exits.

8. A cathode ray display tube according to claim 6, characterised in that the apertures of the other half dynode of the final dynode of the multiplier have elongate exits corresponding to the elongate aperture entrances of said half dynode.

9. A cathode ray display tube according to claim 8, characterised in that the entrances in said other half dynode are elonaate and of smaller cross-sectional area than the aperture exits therein.

10. A cathode ray display tube according to claim 8, characterised in that the aperture entrances in said other half dynode are circular and of smaller cross-sectional area than the aperture exits therein.

11. A cathode ray display tube according to claims 4, characterised in that the other dynodes of the electron multiplier have apertures with circular entrances and exits.

12. A cathode ray display tube according to claim 1, 2 or 3 characterised in that the elongate aperture exits at the output side of the final dynode are symmetrical about a central longitudinal axis.

13. A cathode ray display tube according to claim 12, characterised in that the elongate aperture exits at the output side of the final dynode are symmetrical about a central transverse axis.

* * * * *